US005950704A

United States Patent [19]

Johnson et al.

[11] Patent Number: 5,950,704

[45] Date of Patent: Sep. 14, 1999

[54] REPLICATION OF SURFACE FEATURES FROM A MASTER MODEL TO AN AMORPHOUS METALLIC ARTICLE

[75] Inventors: William L. Johnson, Pasadena; Eric Bakke, Murrieta; Atakan Peker, Aliso Viejo, all of Calif.

[73] Assignees: Amorphous Technologies International, Laguna Niguel; California Institute of Technology, Pasadena, both of Calif.

[21] Appl. No.: 08/683,320

[22] Filed: Jul. 18, 1996

[51] Int. Cl.[6] ..... B22D 23/00

[52] U.S. Cl. ..... 164/47; 164/6

[58] Field of Search ..... 164/6, 15, 37, 164/45, 900, 47; 148/561

[56] References Cited

U.S. PATENT DOCUMENTS

| | | | |
|---|---|---|---|
| 5,288,344 | 2/1994 | Peker et al. . | |
| 5,296,059 | 3/1994 | Masumoto et al. . | |
| 5,306,463 | 4/1994 | Horimura . | |
| 5,312,495 | 5/1994 | Masumoto et al. . | |
| 5,324,368 | 6/1994 | Masumoto et al. . | |
| 5,589,012 | 12/1996 | Hobby et al. | 148/561 |
| 5,711,363 | 1/1998 | Scruggs et al. | 164/113 |

OTHER PUBLICATIONS

A. Kato et al. "Production of Bulk Amorphous $Mg_{85}Y_{10}Cu_5$ Alloy by Extrusion of Atomized Amorphous Powder," *Materials. Trans., JIM*, vol. 35, No. 2 (1994), pp. 125–129.

Y. Kawamura et al., "Full strength compacts by extrusion of glass metal powder at the supercooled liquid state," *Appli. Phys. Lett.*, vol. 67 (14) (1995), p. 2008–2010.

*Primary Examiner*—J. Reed Batten, Jr.

*Attorney, Agent, or Firm*—Gregory Garmong

[57] ABSTRACT

The surface features of an article are replicated by preparing a master model having a preselected surface feature thereon which is to be replicated, and replicating the preselected surface feature of the master model. The replication is accomplished by providing a piece of a bulk-solidifying amorphous metallic alloy, contacting the piece of the bulk-solidifying amorphous metallic alloy to the surface of the master model at an elevated replication temperature to transfer a negative copy of the preselected surface feature of the master model to the piece, and separating the piece having the negative copy of the preselected surface feature from the master model.

16 Claims, 5 Drawing Sheets

REPLICATION OF SURFACE FEATURES FROM A MASTER MODEL TO AN AMORPHOUS METALLIC ARTICLE

The U.S. Government has certain rights in this invention pursuant to Grant No. FG03-86ER45242 awarded by the department of Energy.

BACKGROUND OF THE INVENTION

This invention relates to the replication of surface features, and in particular to such replication to a metallic surface.

Surfaces and their features are replicated in a number of fields of technology. Replicas are sometimes made in order to study the features of the surface. In other instances, highly specialized patterns of features are formed on a master model using costly precision machining, etching, or photoetching techniques. The features are replicated from the master model to make large numbers of copies of the specialized features.

In one common example, a plastic sheet is placed against the surface whose features are to be replicated. The plastic is heated or partially dissolved so that it flows and closely contacts the features on the surface, allowed to cool or dry, and then stripped from the surface. If the procedure is performed carefully, the stripped plastic sheet has a surface profile and morphology that closely matches those of the surface being replicated. The plastic surface may then be used in this form, or it may be further processed, as by application of a metallic layer using a shadowing procedure.

Although useful for some applications, the plastic replicas are not sufficiently strong and durable for many others. Additionally, even when an overlying metallic layer is present on the plastic, the plastic replicas do not exhibit conventional metallic-like physical properties such as interaction with electromagnetic radiation and resistance to heat.

There have been attempts to make metallic replicas of master model surfaces to overcome the mechanical and physical shortcomings of the plastic replica approach. These attempts have to a large degree not been fully successful, because the replication of the surface features is not sufficiently faithful for fine-scale features on the order of one micrometer in width or smaller, because the metallic surface properties of the replica are undesirably altered, and other reasons.

A reliable approach to the fabrication of precise metallic replicas is needed in order to manufacture products such as durable secondary masters used in the production of products such as compact disks, optical devices, and directional plastic lenses, and also for direct applications such as light-absorptive panels for spacecraft applications. The present invention fulfills this need, and further provides related advantages.

SUMMARY OF THE INVENTION

The present invention provides a method for replicating surfaces and replicas prepared by this approach, and in particular for replicating fine-scale features of a size of one micrometer or smaller. The replicas are made of a metallic material that is strong, durable, and exhibits the physical properties of metals, such as response to incident electromagnetic radiation and resistance to heat. The replicas are highly accurate reproductions of the surfaces and surface features being replicated. The approach is readily practiced on an industrial scale, permitting the large-scale production of replicas.

In accordance with the invention, a method of replicating the surface features of an article comprises the steps of preparing a master model having a preselected surface feature thereon which is to be replicated, and replicating the preselected surface feature of the master model. The replication is accomplished by providing a piece of a bulk-solidifying amorphous metallic alloy having a thickness greater than a minimum depth of the surface feature, contacting the piece of the bulk-solidifying amorphous metallic alloy to the surface of the master model at an elevated replication temperature under an external replication pressing pressure, to transfer a negative copy of the preselected surface feature of the master model to the piece, and separating the piece having the negative copy of the preselected surface feature from the master model. To achieve replication of fine-scale features on the order of 1 micrometer in size, the external replication pressing pressure is greater than about 260 pounds per square inch (psi).

Preferably, the elevated replicating temperature is from about 0.75 $T_g$ to about 1.2 $T_g$, where $T_g$ is measured in °C., most preferably from about 0.75 $T_g$ to about 0.95 $T_g$. The replication pressure is preferably from about 260 to about 40,000 psi, more preferably from about 2600 to about 40,000 psi.

The replica is made of a bulk-solidifying amorphous alloy. Bulk-solidifying amorphous alloys are a class of amorphous alloys that can retain their amorphous structures when cooled at rates of about 500° C. per second or less, depending upon the alloy composition. Bulk-solidifying amorphous alloys have been described, for example, in U.S. Pat. Nos. 5,288,344 and 5,368,659, whose disclosures are incorporated by reference.

Bulk-solidifying amorphous alloys have properties that make their use in fine-scale replication particularly advantageous. They do not have a crystalline structure, and accordingly have no grains and grain boundaries. It is the presence of the grains and grain boundaries that often limit the spatial resolution of replicas formed from conventional crystalline metallic materials. Bulk-solidifying amorphous alloys are characterized by very smooth surfaces and a low coefficient of friction at their surfaces. Consequently, the replication of details of fine-scale surface features is good. Also, there is little or no need for a lubricant between the amorphous material and the master model. In some cases, the presence of the lubricant can adversely affect the replication of fine details. The bulk-solidifying amorphous metallic alloys exhibit metal deformation and flow properties at elevated temperatures that are amenable to flow around both coarse and fine-scale surface features, permitting their faithful replication. Lastly, bulk-solidifying amorphous alloys have excellent mechanical and physical properties. They exhibit good strength, hardness, and wear resistance. They have good corrosion resistance as a result of the absence of grain boundaries. Thus, the replicas are stable and do not degrade during service.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
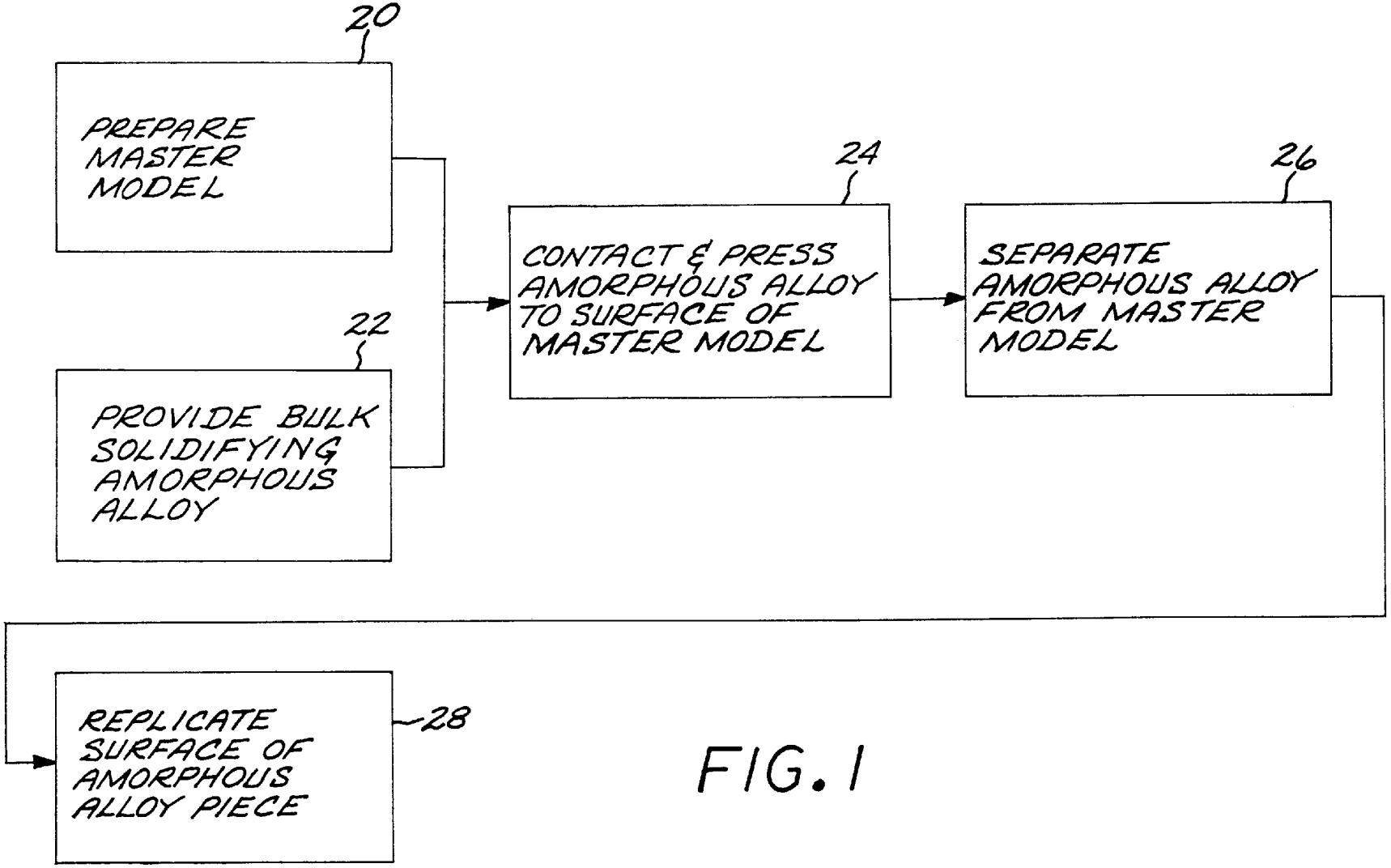
FIG. 1 is a process flow diagram for one approach according to the invention for replicating a surface.
Figure 2A:
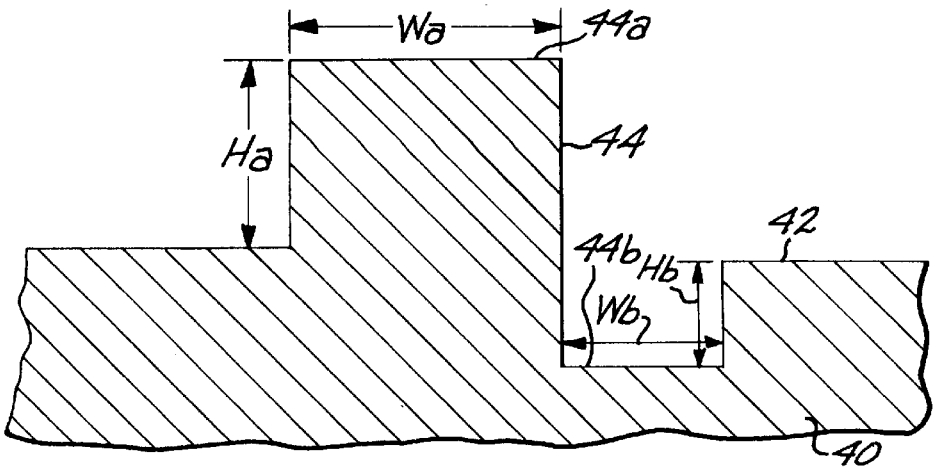
FIG. 2A is a profile view of a surface of a master model to be replicated.

FIG. 1 depicts a procedure for preparing a replication of a master model. The master model is prepared, numeral 20. The master model is an article having a preselected surface feature thereon which is to be replicated. FIG. 2A depicts such a master model 40, with a surface 42 and a surface feature 44 thereon that is to be replicated. The surface feature 44 may be either raised (44*a*) above the surface 42 or recessed below (44*b*) the surface. The minimum lateral dimension of each surface feature 44, $W_a$ for the feature 44*a* and $W_b$ for the feature 44*b*, is its pertinent size as used herein for the purposes of the discussion of replication of fine surface features. Each surface feature may also be characterized as having a height dimension, $H_a$ for the surface feature 44*a* and $H_b$ for the surface feature 44*b*.

The master model 40 with the surface feature 44 may be prepared in any operable manner. By way of example and not limitation, the surface feature 44 may be machined mechanically or by laser processing, chemically etched, punched or pressed, or cast. The surface feature 44 of the master model 40 is termed a "positive" feature, whether it is raised above the surface or recessed into the surface, much in the sense of positive/negative terminology as used in photography. This relation will be discussed in greater detail in relation to FIGS. 2B and 2C.

A piece of a bulk-solidifying amorphous metallic alloy is provided, numeral 22. The piece has a total thickness T between its opposing surfaces 47 that is larger than, and preferably much larger than, than the heights H of any of the surface features 44 to be replicated. The amorphous alloy is a metal alloy that can be cooled from the melt to retain the amorphous form in the solid state in large-sized pieces, termed herein a "bulk-solidifying amorphous metal". Such metals can be cooled from the melt at relatively low cooling rates, on the order of about 500° C. per second or less, yet retain an amorphous structure after cooling. These bulk-solidifying amorphous metals do not experience a liquid/solid crystallization transformation upon cooling, as with conventional metals. Instead, the highly fluid, non-crystalline form of the metal found at high temperatures becomes more viscous as the temperature is reduced, eventually taking on the outward physical properties of a conventional solid.

This ability to retain an amorphous structure even with a relatively slow cooling rate is to be contrasted with the behavior of other types of amorphous metals that require cooling rates of at least about $10^4$–10$^{6}$° C. per second from the melt to retain the amorphous structure upon cooling. Such metals can only be fabricated in amorphous form as thin ribbons or particles. Such a metal has limited usefulness because it cannot be prepared in the thicker sections required for typical articles of the type prepared by replication.

Even though there is no liquid/solid crystallization transformation for a bulk-solidifying amorphous metal, a "melting temperature" $T_m$ may be defined as the temperature at which the viscosity of the metal falls below $10^2$ poise upon heating. It is convenient to have such a $T_m$ reference to describe a temperature above which the viscosity of the material is so low that, to the observer, it apparently behaves as a freely flowing liquid material.

Similarly, an effective "freezing temperature", $T_g$ (often referred to as the glass transition temperature), may be defined as the temperature below which the equilibrium viscosity of the cooled liquid is above $10^{13}$ poise. At temperatures below $T_g$, the material is for all practical purposes a solid. For the zirconium-titanium-nickel-copper-beryllium alloy family of the preferred embodiment, $T_g$ is in the range of about 310–400° C. and $T_m$ is in the range of about 660–800° C. (An alternative approach to the determination of $T_g$ used in some other situations is based upon measurements by differential scanning calorimetry, which yields different ranges. For the present application, the above definition in terms of viscosity is to be used.) At temperatures in the range between $T_m$ and $T_g$, the viscosity of the bulk-solidifying amorphous metal increases slowly and smoothly with decreasing temperature.

A most preferred bulk-solidifying amorphous metallic alloy family has a composition range, in atom percent, of from about 45 to about 67 percent total of zirconium plus titanium, from about 10 to about 35 percent beryllium, and from about 10 to about 38 percent total of copper plus nickel. A substantial amount of hafnium can be substituted for some of the zirconium and titanium, aluminum can be substituted for the beryllium in an amount up to about half of the beryllium present, and up to a few percent of iron, chromium, molybdenum, or cobalt can be substituted for some of the copper and nickel. These bulk-solidifying alloys are known and are described in U.S. Pat. No. 5,288,344. One most preferred such metal alloy material has a composition, in atomic percent, of about 41.2 percent zirconium, 13.8 percent titanium, 10 percent nickel, 12.5 percent copper, and 22.5 percent beryllium. It has a liquidus temperature of about 720° C. and a tensile strength of about 1.9 GPa. Another most preferred such metallic alloy has a composition, in atomic percent, of about 46.75 percent zirconium, 8.25 percent titanium, 10.0 percent nickel, 7.5 percent copper, and 27.5 percent beryllium.

Another family of bulk-solidifying amorphous alloy materials has a composition range, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent. A most preferred metal alloy of this group has a composition, in atomic percent, of about 60 percent zirconium about 15 percent aluminum, and about 25 percent nickel. This alloy family is less preferred than that described in the preceding paragraph.

The piece of the bulk-solidifying amorphous metallic alloy is contacted to the surface of the master model 40, numeral 24. The contacting may be accomplished in any operable manner, and three approaches are preferred. In the first, the piece of the bulk-solidifying amorphous metallic alloy is heated to a temperature greater than the elevated replication temperature and greater than $T_m$, and cast against the surface of the master model at the replication temperature. In the second, the piece of the bulk-solidifying amorphous metallic alloy is heated to the elevated replication temperature, and thereafter pressed against the surface of the master model with an external pressing pressure. In the third, the piece of the bulk-solidifying amorphous metallic alloy is pressed against the surface of the master model with an external pressing pressure, and simultaneously heated to the elevated replication temperature while continuing to apply the external pressing pressure.

The replication temperature is from about 0.75 $T_g$ to about 1.2 $T_g$, where $T_g$ is measured in °C., which for the preferred amorphous alloy is from about 240° C. to about 385° C. The deformation behavior of the bulk-solidifying metallic alloy can best be described by its viscosity $\eta$, which is a function of temperature. At temperatures below about 0.75 $T_g$, the viscosity is very high. Replication at temperatures below about 0.75 $T_g$ requires such high loads that the master model may be damaged or subjected to excessive wear, the time to complete the replication is excessively long, and the replication of small features may not be faithful. At replication temperatures higher than about 1.2 $T_g$, the viscosity is low and replication is easy, but there is a tendency to crystallization of the alloy during replication, so that the benefits of the amorphous state are lost. Additionally, at replication temperatures above 1.2 $T_g$ there is a tendency toward embrittlement of the alloy, which is believed to be due to a spinoidal decomposition reaction. It is preferred that the replication temperature be at the lower end of the range of about 0.75 $T_g$ to about 1.2 $T_g$, to minimize the possibility of embrittlement. Thus, a minimum replication temperature of about 0.75 $T_g$ and a maximum replication temperature of about 0.95 $T_g$ are preferred to minimize the incidence of embrittlement and also to permit the final replicated article to be cooled sufficiently rapidly to below the range of any possible embrittlement, after replication is complete.

The operable range may instead be expressed in terms of the viscosities of the bulk-solidifying amorphous metallic alloy which are operable.

In those embodiments where the piece of bulk-solidifying amorphous metallic alloy is heated from a lower temperature to the replication temperature (as distinct from being cooled to the replication temperature from a higher temperature), the heating is preferably accomplished with an external load applied to the piece of the bulk-solidifying amorphous metallic alloy that is to form the replica, at least as the temperature approaches the replication temperature. Studies have shown that heating with an applied external load results in a lower viscosity at the replication temperature than heating without an applied load.

The heating from a lower temperature to the replication temperature is also preferably accomplished relatively rapidly rather than in an equilibrium manner. FIG. 7 illustrates the viscosity $\eta$ of a bulk-solidifying amorphous metallic alloy within the preferred composition range as a function of temperature, for slow (equilibrium) heating, and two faster heating rates. The faster heating rates, above about 0.1° C. per second, result in substantially reduced viscosity at temperatures in the range of about 0.75 $T_g$ to about 1.2 $T_g$. The lower viscosity permits the replication to be accomplished with lower applied loads, resulting in a lesser requirement for press capability and reducing the potential damage to the master model.

Applying a sufficiently high external pressure between the piece of the bulk-solidifying amorphous metallic alloy and the master model during the contacting step 24 is a key to the attainment of a satisfactory replication of fine-scale features. As described in U.S. Pat. No. 5,324,368, in the past it has been known to deform thin sheets of amorphous alloys into recesses at temperatures between $T_g$ and $T_m$, with applied pressures of about 50 pounds per square inch (psi) or less. This processing, essentially a blow molding, is not of the same nature as the present replication approach. In the procedure of the '368 patent, the final thickness of the piece of amorphous metal is less than, usually much less than, the associated depth of the recess. In the present approach, by contrast, the final thickness of the piece of amorphous metal after replication is complete is much greater than the height of the surface features. This larger thickness of the final amorphous piece is necessary to attain a mechanically stable replicated structure. The deformation in the approach of the '368 patent is therefore largely in a bending mode, and it is therefore possible to use small applied pressures. In the present approach, however, bulk deformation of the relatively thick amorphous alloy piece is required to force the amorphous metal into contact with the surface features, and greater applied pressing pressures are required.

Because the process of the '368 patent was accomplished at a higher temperature than with the present approach, it might be thought that the lower viscosity experienced at the higher temperature would suggest that lower pressures are satisfactory for replication procedures of the type discussed herein. However, the present inventors have discovered that, because of the surface tension effects in the bulk-solidifying amorphous alloys which are relatively constant with increasing temperature, there is not a simple tradeoff between increasing temperature and reduced pressing pressure.

The replication of fine-scale features into a relatively thick piece of the amorphous alloy therefore requires the use of significantly higher pressing pressures than used in the approach of the '368 patent. A minimum external pressing pressure of about 260 psi is required to replicate fine features in the size range most commonly of interest, a size of about 1 micrometer resolution. (The "external pressure" is the pressure externally applied through the replication apparatus as measured by the applied force of the press divided by the effective area, not the stress within the piece of amorphous metal being deformed.) The pressing pressure required is roughly proportional to 1/W, where W is the minimum width of the surface feature as discussed in relation to FIG. 2A. Thus, higher pressing pressures are required to replicate even finer features. For example, to replicate features with about 0.1 micrometer resolution, a size of interest for optical applications, the pressing pressure must be at least about 2600 psi. If the pressure is less, the surface tension effects of the amorphous metal prevent satisfactory replication. There is no upper limit to the pressure that can be used, but as a practical matter it is preferred that the replication pressure be no higher than necessary, most preferably not to exceed about 40,000 psi, to prevent damage to the master model and the features thereon.

The amorphous alloy piece 46 is separated from the master model 40, numeral 26. It may be necessary to utilize an ejector mechanism, as will be described subsequently, or separation may be achieved without such a mechanism.

Figure 2B:
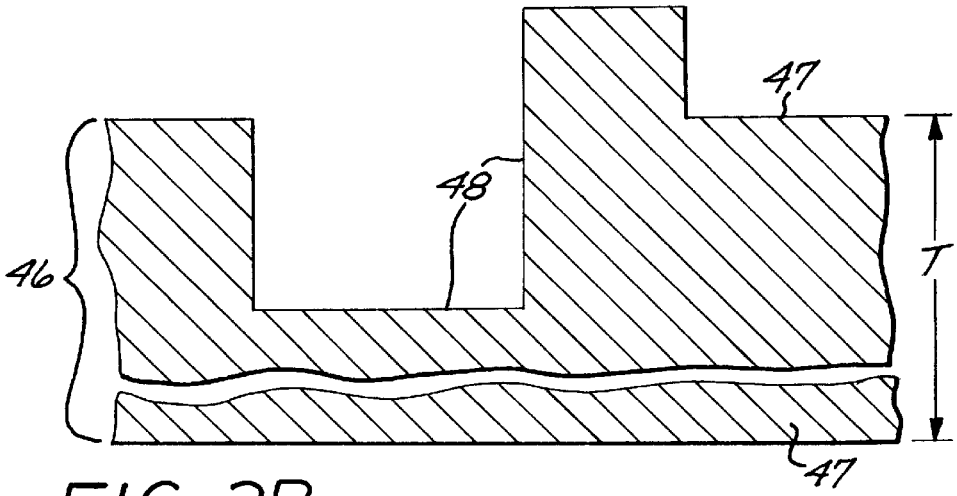
FIG. 2B is a profile view of a surface of a negative replication of the master model of FIG. 2A.

FIG. 2B illustrates a piece 46 of the bulk-solidifying amorphous metallic alloy, having a total thickness T, that has been used to replicate the positive surface features 44 of the master model 40 of FIG. 2A. The replicated surface feature 48 is a "negative" of the corresponding surface feature 44 of the master model 40 of FIG. 2A. That is, high spots in the surface feature 44 are replicated as low spots in the surface feature 48, and low spots in the surface feature 44 are replicated as high spots in the surface feature 48. Otherwise, however, the shapes and dimensions of the surface features are faithfully reproduced in the piece 46.

Figure 2C:
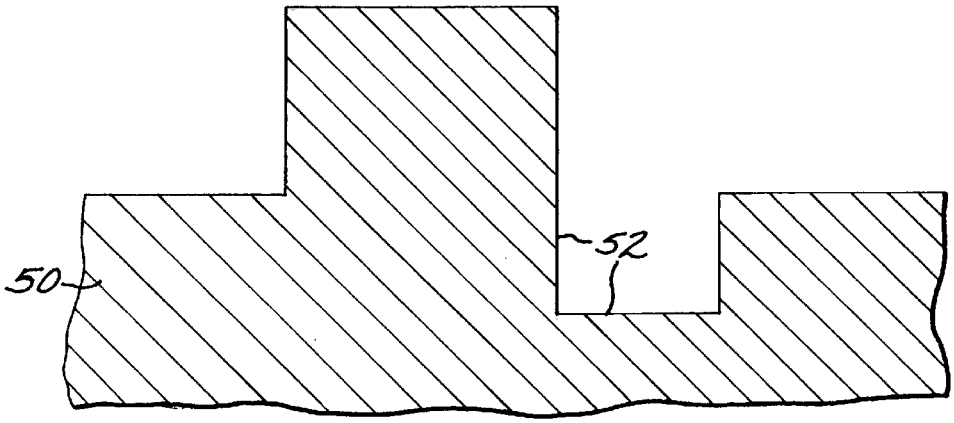
FIG. 2C is a profile view of a surface of a positive replication of the negative replication of FIG. 2B.

The piece 46 may either be used in this form as a negative replication of the surface 42. Instead, the surface of the piece 46 may in turn be replicated to produce a positive secondary replication, numeral 28. FIG. 2C illustrates such a secondary replication 50 with a "positive" surface feature 52. That is, high spots in the surface feature 44 are replicated as high spots in the surface feature 52, and low spots in the surface feature 44 are replicated as low spots in the surface feature 52. Otherwise, the shapes and dimensions of the surface features are faithfully reproduced in the secondary replication 50.

The secondary replication of step 28 is optionally applied to obtain a positive replication of the master model 40. The step 28 may be used with a bulk-solidifying amorphous metallic replicating material or another material such as a plastic. Each piece 46 may be used to produce thousands of the secondary replications. The amorphous material of the piece 46 is hard, wear resistant, scratch resistant, corrosion resistant, does not plastically flow easily, and typically does not require the use of a lubricant to produce the secondary replications. The amorphous material piece 46 is thus highly useful as intermediate tooling to produce parts such as plastic compact disks and the like from the master model.

Figure 3A:
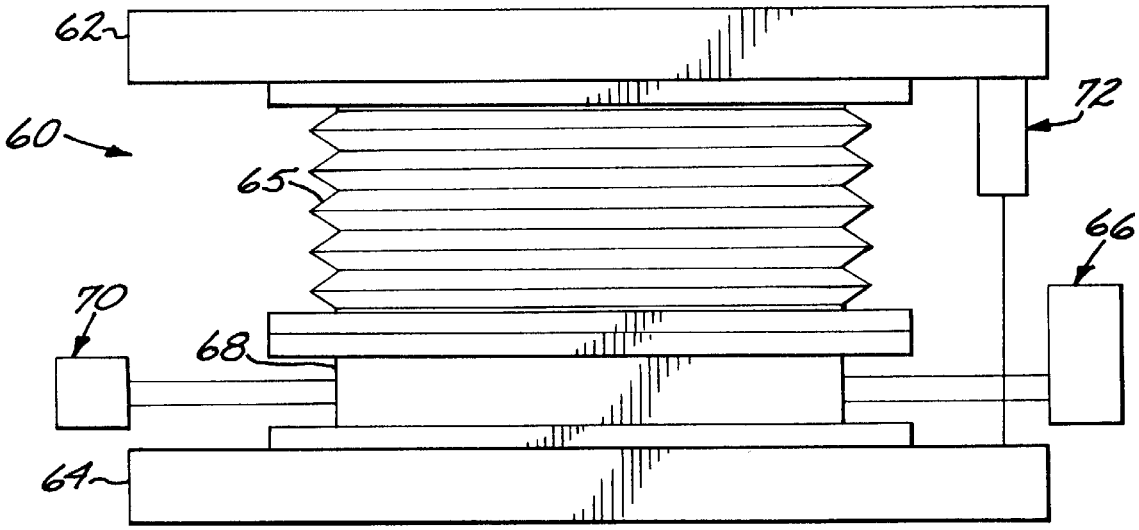
FIG. 3A is a schematic external elevational view of an apparatus for replicating surfaces.
Figure 3B:
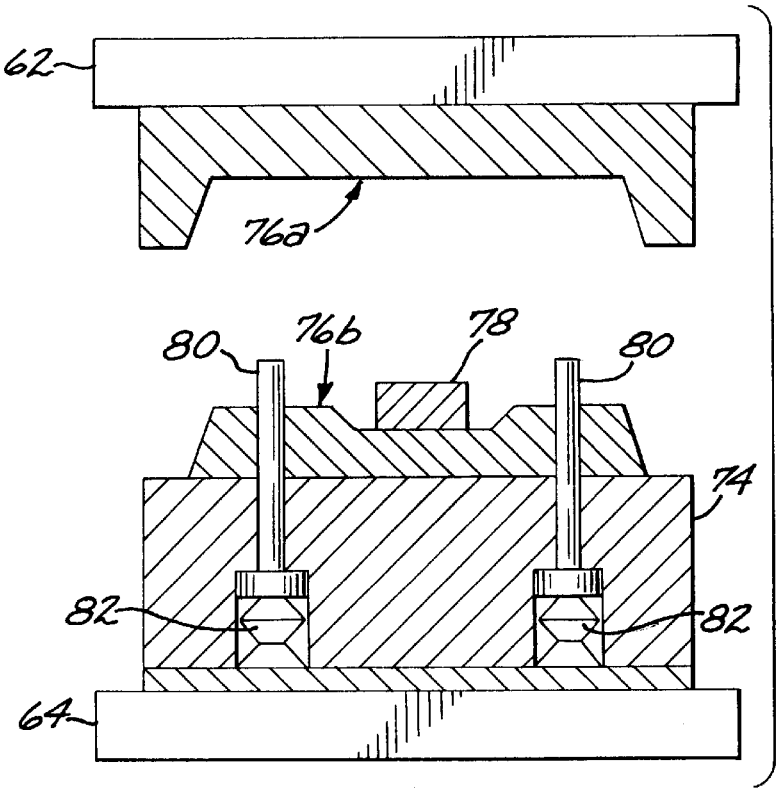
FIG. 3B is a schematic elevational view of the replication fixture used in the apparatus of FIG. 3A.
Figure 4:
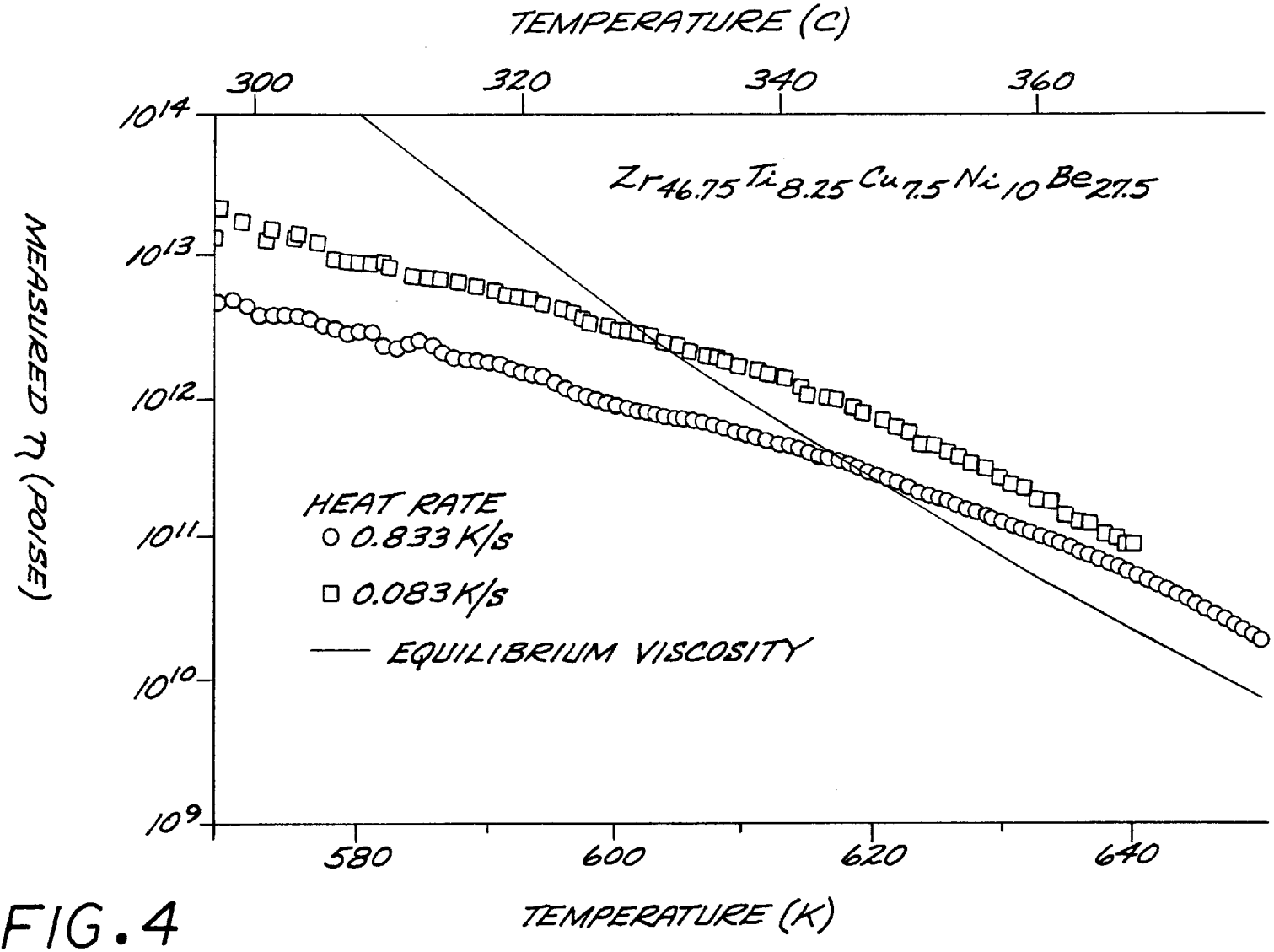
FIG. 4 is a graph of viscosity of a bulk-solidifying amorphous metallic alloy as a function of temperature.

FIGS. 3A and 3B schematically illustrate an apparatus 60 for performing replications according to the present invention and as shown in FIG. 1. As shown in the exterior view of FIG. 3A, the apparatus 60 includes a heated top platen 62 and a facing but spaced-apart heated bottom platen 64. A gas-tight bellows 65 protects the internal replicating components to be described subsequently and allows a vacuum to be drawn by a turbo vacuum pump 66 connected to the interior of the bellows 66 through a feedthrough collar 68. A vacuum gauge 70 measures the vacuum level within the interior of the bellows 66, and a linear displacement transducer 72 measures the change in the separation of the platens 62 and 64.

Preparation of replicas within a vacuum is highly desirable for some applications. If the surface of the replica or the master model is allowed to oxidize during a replication in air, the brittle oxide may later crack and fall away, changing the dimensions of the surface features or their replications.

FIG. 3B shows the replication fixturing within the bellows 65. A support base in the form of a copper-beryllium alloy mold 74 sits upon the bottom platen 64. Because heating occurs in a vacuum, the replication apparatus must be heated by conduction. The use of the copper-beryllium alloy as the mold material provides acceptable strength and also acceptable thermal conductivity. A top master model 76*a* is supported from the top platen 62, and a bottom master model 76*b* rests on the top of the mold 74, in a facing relationship to the top master model 76*a*. A piece 78 of the bulk-solidifying amorphous metallic alloy is placed between the two master models 76*a* and 76*b*. The master models 76*a* and 76*b* each serve the function of the master model 40 discussed previously. Two such master models 76*a* and 76*b* are shown to illustrate the point that different sets of surface features from the two master models may be replicated onto the opposite sides of the piece 78 of the bulk-solidifying amorphous metallic alloy, but of course such dual-replication is not required. Ejection pins 80 supported on Belleville spring washers 82 extend upwardly through the mold serve to separate the master models 76*a* and 76*b* at the completion of the replication process. Such assisted separation is typically required because with the present approach the contact between the amorphous alloy piece and the master model is so good that intrusion into scratches and other very fine features may cause the piece of amorphous material to adhere tightly to the master model and resist separation.

In a working embodiment of the apparatus 60 build by the inventors, the platens 62 and 64 are the working rams of a MTP-14 hydraulic press manufactured by Tetrahedron Associates, Inc. The platens may be heated to temperatures as high as 1000° F. and may apply a force through the apparatus of up to 48,000 pounds. The interior of the bellows 65 may be evacuated to a vacuum of about $9\times10^{-6}$ Torr at a temperature of 645° F., a typical processing temperature. As an alternative, the replication may be conducted in a back-filled inert atmosphere such as helium, which has good thermal conductivity.

Figure 5:
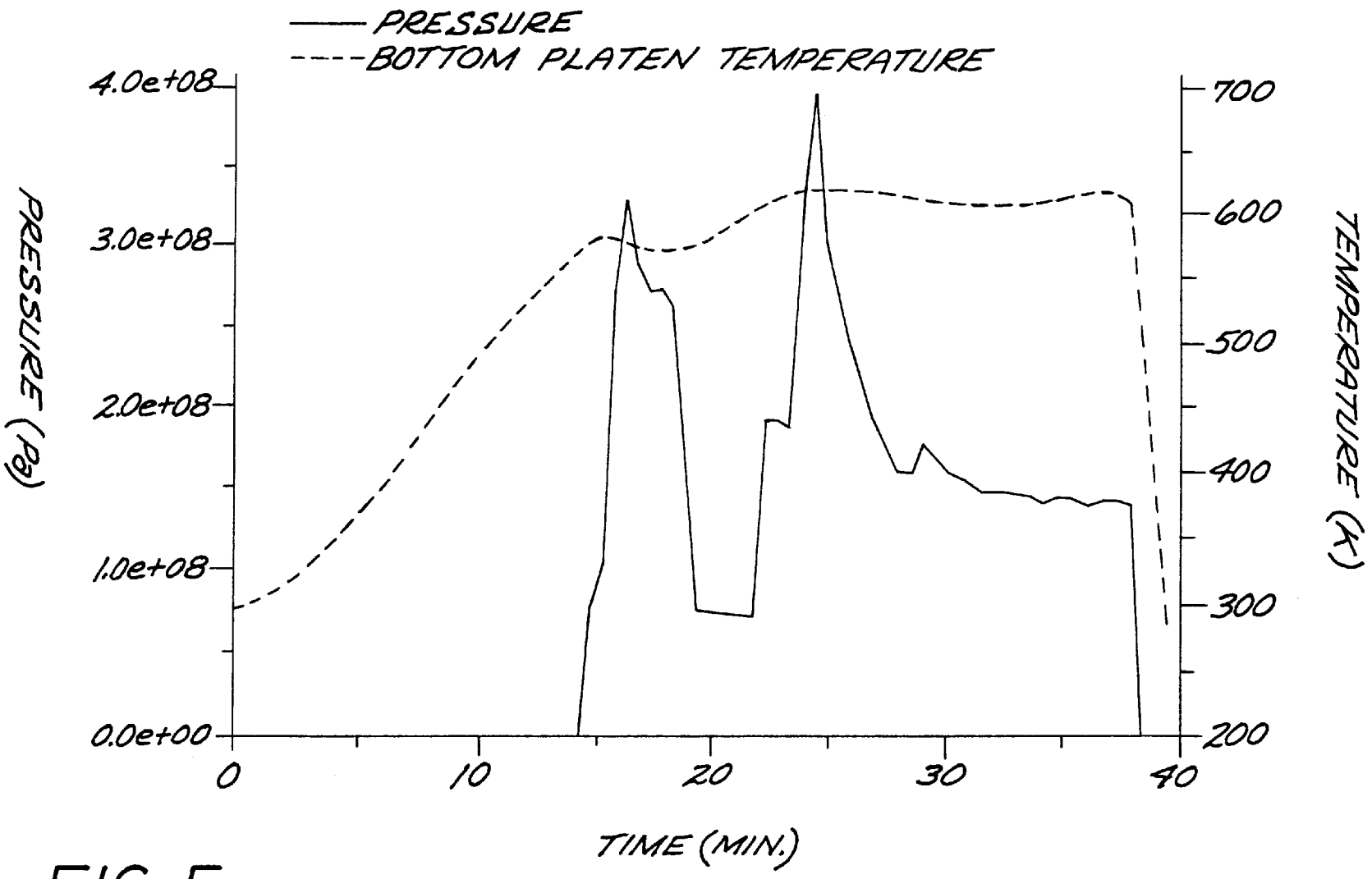
FIG. 5 is a graph of pressure and temperature as a function of time for a typical replication procedure.

In the preferred procedure for practicing the invention, the apparatus is assembled. The platen heaters are turned on with a high power input so as to heat the amorphous metallic alloy piece 78 at a relatively high rate, more than about 0.1° C. per second. A relatively small preload is applied to the master molds 76*a* and 76*b* through the piece 78 of the bulk-solidifying amorphous material as the piece 78 heats and its temperature approaches the replication temperature. As the temperature of the piece 78 approaches the replication temperature, the pressure is increased, the amorphous metallic alloy piece softens and flows, and the replication occurs. The use of the preload and the relatively rapid heating rate results in acceptable flow and replication at a lower temperature and lower total pressure that would otherwise be required. For one preferred bulk-solidifying amorphous alloy having a composition, in atomic percent, of 41.2 percent zirconium, 13.8 percent titanium, 12.5 percent copper, 10 percent nickel, and 22.5 percent beryllium, FIG. 5 illustrates a typical pressure/temperature-time profile. Replication requires about 15 minutes at a temperature of 645° F.

The following examples illustrate aspects of the invention, but should not be taken as limiting of the invention in any respect.

EXAMPLE 1

The apparatus of FIGS. 3A–3B has been used with the approach of FIG. 1 to prepare replicas of surfaces. The master model was prepared from a stainless steel disk 18 millimeters in diameter and 7 millimeters thick. The disk was metallographically polished on one side, with final polishing using a one micrometer diamond paste. A series of small indentations were made on the polished surface using a Vickers diamond indenter under different loads. The indentations were about 100 micrometers apart, and the lengths of the diagonals of the pyramidal indentations ranged from 4 to 50 micrometers.

A replica was made from this master model using a piece of a bulk-solidifying amorphous metallic alloy having a composition, in atomic percent, of 46.75 percent zirconium, 8.25 percent titanium, 7.5 percent copper, 10 percent nickel, and 27.5 percent beryllium, a composition that is notably stable above $T_g$ against crystallization. The piece was a 10 millimeter diameter, 7 millimeter thick disk. The amorphous alloy piece was placed on top of the steel disk, and the assembly placed into the apparatus 60. The vacuum capability of the apparatus was not used, and the entire replication procedure was accomplished in air. Initially, a force of 300 pounds was applied through the platens. This force was maintained low to avoid damage to the master model when the temperature was low. The master model and amorphous alloy were heated to a replication temperature of about 340° C. The applied force was increased to about 2000 pounds and maintained for 5 minutes. The force was thereafter released and the platens were water cooled.

The piece bearing the replica pyramids (the negative of the indentations) was observed under a light microscope at a 500X magnification. The pyramids had sharp corners, indicating a faithful replication.

EXAMPLE 2

The approach of Example 1 was repeated to successfully replicate features having a size of about 0.5 micrometers.

The present approach provides a technique for replicating fine surface features into a metallic piece, which may be used as replicated or used as a tool to make further replicas. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of replicating the surface features of an article, comprising the steps of:

preparing a master model having a preselected surface feature thereon which is to be replicated; and replicating the preselected surface feature of the master model by the steps of providing a piece of a bulk-solidifying amorphous metallic alloy having a thickness greater than a depth of the surface feature, contacting the piece of the bulk-solidifying amorphous metallic alloy to the surface of the master model at an elevated replication temperature and with an external replication pressing pressure, to transfer a negative copy of the preselected surface feature of the master model to the piece, and separating the piece having the negative copy of the preselected surface feature from the master model.

2. The method of claim 1, wherein the step of preparing a master model includes the steps of providing a master model material having a surface thereon; and processing the surface of the master model to form a preselected surface feature thereon.

3. The method of claim 1, wherein the step of contacting includes the steps of heating the bulk-solidifying amorphous metallic alloy to a temperature greater than the elevated replication temperature, and casting the bulk-solidifying amorphous metallic alloy against the surface of the master model.

4. The method of claim 3, wherein the step of heating includes the step of heating the bulk-solidifying amorphous alloy at a rate of at least about 0.1° C. per second.

5. The method of claim 3, including an additional step, after the step of casting, of applying a pressure to force the cast bulk-solidifying amorphous metallic alloy against the surface of the master model.

6. The method of claim 1, wherein the step of contacting includes the steps of heating the bulk-solidifying amorphous metallic alloy to the elevated replication temperature, and thereafter pressing the bulk-solidifying amorphous metallic alloy against the surface of the master model.

7. The method of claim 6, wherein the step of heating includes the step of heating the bulk-solidifying amorphous alloy at a rate of at least about 0.1° C. per second.

8. The method of claim 1, wherein the step of contacting includes the steps of pressing the bulk-solidifying amorphous metallic alloy against the surface of the master model, and simultaneously heating the bulk-solidifying amorphous metallic alloy and the master model to the elevated replication temperature while continuing to apply the pressing pressure.

9. The method of claim 1, including the steps of repeating the step of replicating for at least one additional piece of the bulk-solidifying amorphous metallic alloy.

10. The method of claim 1, wherein the replication temperature is from about 0.75 $T_g$ to about 1.2 $T_g$ where $T_g$ is the glass transition temperature.

11. The method of claim 1, wherein the replication temperature is from about 0.75 $T_g$ to about 0.95 $T_g$, where $T_g$ is the glass transition temperature.

12. The method of claim 1, wherein the step of providing a piece of a bulk-solidifying amorphous metallic alloy includes the step of providing a bulk-solidifying amorphous alloy having a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

13. The method of claim 1, wherein the step of providing a piece of a bulk-solidifying amorphous metallic alloy includes the step of providing a bulk-solidifying amorphous alloy having a composition, in atomic percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent.

14. The method of claim 1, including an additional step, after the step of replicating the preselected surface feature, of replicating the piece having the negative copy of the preselected surface feature to form a positive copy of the preselected surface feature.

15. The method of claim 1, wherein the external replication pressing pressure is at least about 260 pounds per square inch.

16. The method of claim 1, wherein the step of contacting includes the step of contacting the piece to the surface of the master model in a vacuum.

* * * * *